US009139270B2

(12) United States Patent
Pirtle

(10) Patent No.: US 9,139,270 B2
(45) Date of Patent: Sep. 22, 2015

(54) SYSTEM FOR REFLOATING GROUNDED VESSELS

(71) Applicant: James Pirtle, New Orleans, LA (US)

(72) Inventor: James Pirtle, New Orleans, LA (US)

( * ) Notice: Subject to any disclaimer, the term of this patent is extended or adjusted under 35 U.S.C. 154(b) by 71 days.

(21) Appl. No.: 14/045,486

(22) Filed: Oct. 3, 2013

(65) Prior Publication Data

US 2015/0096483 A1 Apr. 9, 2015

(51) Int. Cl.

| | |
|---|---|
| ***B63C 7/12*** | (2006.01) |
| ***B63C 7/10*** | (2006.01) |
| ***B63C 7/04*** | (2006.01) |

(52) U.S. Cl.

CPC ... *B63C 7/04* (2013.01); *B63C 7/10* (2013.01); *B63C 7/12* (2013.01)

(58) Field of Classification Search

CPC ..... B63C 7/12; B63C 7/10
USPC ..... 114/44, 68, 54
See application file for complete search history.

(56) References Cited

U.S. PATENT DOCUMENTS

| | | | | | |
|---|---|---|---|---|---|
| 1,293,899 | A * | 2/1919 | Pendergast | 114/54 |
| 3,358,884 | A * | 12/1967 | Link | 222/94 |
| 3,710,746 | A * | 1/1973 | Mcdonald | 114/333 |
| 3,722,448 | A * | 3/1973 | Leonardi | 114/55 |
| 3,732,837 | A * | 5/1973 | Hogan | 114/315 |
| 3,814,043 | A * | 6/1974 | Krout | 114/54 |
| 4,084,529 | A * | 4/1978 | Katernberg | 114/46 |
| 4,495,880 | A * | 1/1985 | Maniscalco et al. | 114/123 |
| 4,887,541 | A * | 12/1989 | Rodemann | 114/68 |
| 4,979,451 | A * | 12/1990 | Searle | 114/54 |
| 5,094,181 | A * | 3/1992 | Fuerst | 114/54 |
| 5,183,001 | A * | 2/1993 | Stranzinger | 114/266 |
| 5,411,425 | A * | 5/1995 | Rinker | 441/130 |
| 5,755,172 | A * | 5/1998 | Fryburg | 114/52 |
| 5,860,379 | A * | 1/1999 | Moody | 114/54 |
| 6,080,027 | A * | 6/2000 | Rodemann | 441/41 |
| 6,470,818 | B1 * | 10/2002 | Mears et al. | 114/68 |
| 6,484,656 | B2 * | 11/2002 | Mears et al. | 114/68 |
| 6,598,550 | B1 * | 7/2003 | Patel | 114/54 |
| 6,745,714 | B1 * | 6/2004 | Faber | 114/263 |
| 6,802,274 | B2 * | 10/2004 | Mears et al. | 114/68 |
| 6,830,004 | B2 * | 12/2004 | Mears et al. | 114/68 |
| 7,644,673 | B2 * | 1/2010 | Schmitt | 114/68 |
| 2009/0044740 | A1 * | 2/2009 | Imel et al. | 114/263 |
| 2011/0188932 | A1 * | 8/2011 | James et al. | 405/2 |

* cited by examiner

*Primary Examiner* — Lars A Olson
*Assistant Examiner* — Jovon Hayes
(74) *Attorney, Agent, or Firm* — Keaty Law Firm, LLC

(57) ABSTRACT

A system for refloating a grounded floatable vessel uses cylinder-shaped inflatable buoyant rollers that are placed under the vessel hull, inflated until they support the bottom hull and then caused to roll seaward while carrying the vessel into the water. An independently propelled vehicle pulls the vessel resting on the rollers into the water. An operator wirelessly controls inflation and deflation of the rollers to ensure stability of the vessel during the refloating operation.

12 Claims, 7 Drawing Sheets

SYSTEM FOR REFLOATING GROUNDED VESSELS

BACKGROUND OF THE INVENTION

The invention relates to moving a floatable body that has been stranded on land as a result of a natural disaster, of accidental running aground, or has been deliberately run aground for the purpose of loading and unloading goods, or of landing armed forces or heavy equipment etc.

It is well known that hurricanes, tsunami and similar natural disasters often carry heavy objects, including boats, barges, and small ships onto the dry land. In some cases, the recently floating vessels are stranded several hundred yards from water. Every stranded vessel requires emergency assistance in order to remove the ship from a place of danger, to reduce stress in the hull and to decrease the risk of pollution.

The refloating operations are expensive and time consuming. Stabilizing measures to prevent further damage and keep the ship from being driven harder aground or broaching can be performed soon after the vessel becomes grounded but these measures will not refloat the vessel. Once the vessel is stabilized it must be moved back into the water. Conventional refloating techniques involve the use pulling tugboats to pull the vessel to the water. This technique may suitable if the boat ran aground on a sandbank not far from the water's edge.

However, in the case of a large vessel or rocky terrain, the tug boats may not be used since the pulling action can damage the hull. In some cases, special trolleys are constructed adjacent the grounded vessel. Enormous cranes are used to literally lift the vessel onto a trolley. The trolley is then moved closer to the water's edge and the vessel is unloaded into the water, provided that the hull is still floatable. If any repairs are needed they are performed while the hull remains exposed. Regardless of the technique, the cost of refloating a vessel remains high.

The present invention contemplates elimination of drawbacks associated with conventional methods of refloating grounded vessels and provision of an improved system of moving the grounded vessel back into the water using inflatable rollers placed under the hull of the vessel.

SUMMARY OF THE INVENTION

It is therefore an object of the present invention to provide a system of refloating a grounded vessel using inflatable rollers as support for the vessel hull.

It is another object of the invention to provide a system of refloating a grounded vessel suitable for use on sandy or rocky terrains.

It is a further object of the invention to provide a system of refloating a grounded vessel using individually inflatable rollers that can be inflated or deflated using a wireless control signal.

These and other objects of the invention are achieved through a provision of a system for refloating a grounded vessel having a floatable hull, a hull bottom, a deck, and a bow portion. The system comprises a plurality of inflatable flexible buoyant rollers positionable under the hull bottom while the rollers are deflated. The system uses a source of pressurized air for inflating the inflatable rollers, such as for instance one or more air compressors to gradually inflate the rollers such that the hull bottom completely rests on the rollers.

The system also comprises a means for regulating delivery and release of pressurized air into the inflatable rollers, which includes an individually connected and operated air delivery conduit for each inflatable roller, a pressure regulating valve connected to each air delivery conduit, a pressure release valve connected to each air delivery conduit, and a computer-based control unit for controlling operation of each pressure regulating and each air release valve. If the operator detects that the hull is not even the operator can further inflate individual roller or deflate the individual roller and release air into the atmosphere through the air release valve to stabilize the vessel.

A plurality of video input units, such as video cameras, is strategically located around the grounded vessel and on the vessel deck. The video input devices send live feed signals to the computer based control unit and allow the operator to observe the process of inflating the rollers until the rollers support the hull above ground. An independently propelled land-based or water-based vehicle pulls the vessel seaward using a winch mounted on the vehicle and a length of cable or chain.

The inflatable rollers are formed from cylindrically shaped flexible bags made of puncture resistant material suitable for rolling on rocky and sandy terrain while supporting full weight of the vessel. A swivel connector mounted between the roller air conduit and the inflatable roller has a rotatable joint, which rotates as the rollers rotate and prevents twisting or kinking of the roller air hose.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
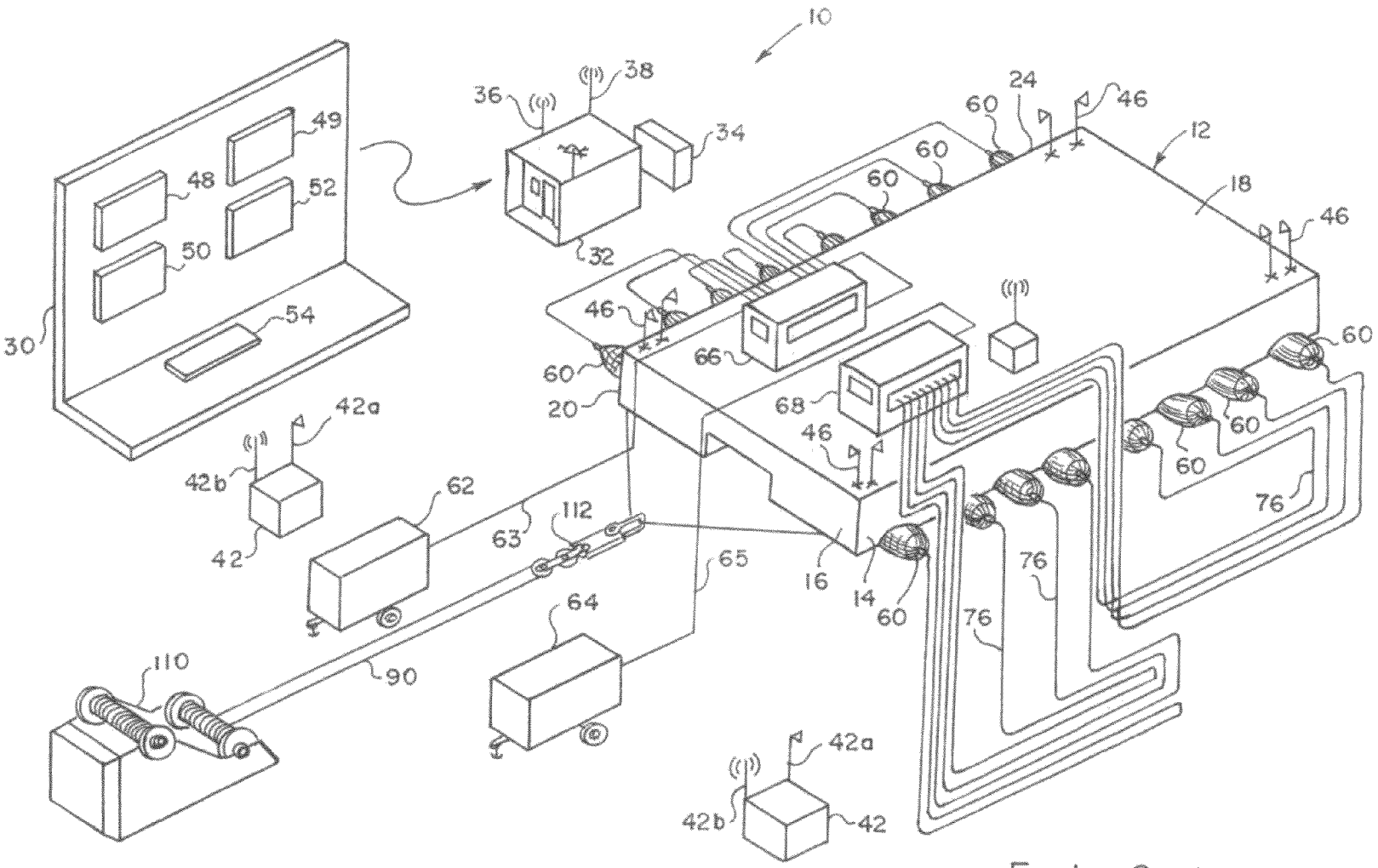
FIG. 1 is a schematic view of the vessel refloating system according to the present invention.

Turning now to the drawings in more detail, numeral 10 designates the computer-based system for refloating grounded vessels according to this invention. The system 10 is designed to support and move a grounded vessel 12 from a land-based location to a body of water, such as a canal, open sea, river, lake, etc. In the drawings, the vessel 12 is shown as a flat-bottom platform barge although it will be understood that other vessels can be successfully refloated using the refloating system 10. The vessel 12 can be hundreds of feet long and weigh more than a thousand tons. The vessel can be also weighted down by unloaded cargo.

The stranded vessel 12 comprises a floatable hull 14, a bottom 16, aft or stern portion 18, forward or bow portion 20, port wall 22, and starboard wall 24. An upper deck 26 extends between the port wall 20 and the starboard wall 24. The upper deck 26 substantially spans the length of the hull 14, such as shown in FIG. 1.

The refloating system 10 comprises a control unit 30 which can be housed in a control unit housing 32. The control unit housing 32 is positioned adjacent the grounded vessel 12. A power source 34 supplies power to the control unit 30. The system 10 is provided with wireless communication means for operating compressors and air valves, as will be described in more detail hereinafter. A control manifold antenna 36 is placed on exterior of the control unit housing 32 to send the control signals to the compressors and receive feedback from video input devices. A video antenna 38 is positioned on the exterior of the housing to process live feed signal from a central video camera data center 40 positioned on the upper deck 26 of the vessel 12.

The central video data center 40 collects video signals from a plurality of video cameras placed strategically around the grounded vessel 12. Video input devices, such as video cameras 42*a* are combined with transducer antennas 42*b* in video camera units 42.

Other video input devices are positioned on the vessel 12. Deck video cameras 46 are mounted on the upper deck 26. In one aspect of the invention, the deck video cameras 46 are mounted in pairs, two—on the forward port side, two—on the forward starboard side, two—on the port aft side, and two—on the starboard aft side. The images collected by the video camera unit 42 and the deck video cameras 46 are collected and processed by the central video camera data center 40 and then transmitted to the computer-based control unit 30 via the video antenna 38.

As can be seen in FIG. 1, the control unit 30 is provided with a plurality of video displays. Two video displays 48 and 49 display separately data from the left side and the right side of the site where the grounded vessel 12 is positioned, as well as the condition of inflatable rollers 60.

The control unit 30 is also provided with a control manifold display 50 and a computer monitor display 52. A keyboard 54 is operationally connected to the computer monitor display 52 to allow an operator to remotely control the components of the refloating system 10. The computer-based control unit processes all signals sent and received from the system components while allowing a centralized operation of the system 10.

The system of the present invention comprises a pair of air compressors 62, 64, which are designed to supply compressed air to the inflatable rollers 60. The air compressor 62 or 64 can be a 185CFM air compressor or other suitable compressor. The air compressors 62, 64 can be diesel-powered and delivered to the site on a truck bed or other suitable modes of delivery. Each of the air compressors 62, 64 supplies compressed air via a respective compressor air hose 63, 65 to an associated control manifold unit 66, 68. The air hoses 63, 65 can be formed as a flexible conduit having 2" diameter. Each control manifold unit 66, 68 comprises a plurality of regulating valves 70 operationally connected to a bank of air cylinders 72 mounted in the manifold control unit 66, 68. The regulating valves 70 communicate with interior of the air cylinders 72 via a plurality of air manifolds 74.

The control manifold units 66, 68 also support a plurality of air release valves 71, which are separately connected to individual rollers 60 and are designed to release air from the inflatable rollers 60 depending on the internal pressure in each the inflatable rollers in order to maintain stability of the vessel hull 14. A battery bank 73 may be provided in the control manifold units 66, 68 to ensure that a back-up power source is available during the refloating operation.

Each of the air regulating valves 70 is operationally connected to a respective inflatable roller 60 by an individual flexible roller air conduit or roller air hose 76. The roller air hose can be a conduit having 1" diameter. A swivel connector member 78 is mounted between the roller air hose 76 and an inlet end 80 of the inflatable roller 60. The swivel connector member 78 comprises a first fixed end 82 designed for engaging the roller air hose 76 and a second fixed end 84 designed for engaging the inflatable roller 60. The swivel connector member 78 is substantially hollow allowing air to move therethrough. A shut off valve 86 is mounted on the swivel connector member 78 for closing the air flow to and from the inflatable roller 60. A pressure gauge 88 is incorporated in the swivel connector member 78 to allow visual evaluation of the pressure in the air flow being delivered or escaping the inflatable roller 60.

The swivel connector member 78 has a pair of elbow connector parts 90 and 92 positioned adjacent the second end 94 of the swivel connector member 78. A first elbow connector part 90 is capable of rotating about an axis 91 at the joint 94 and about an axis 93 at the joint 96. The joint 94 allows rotation of the first elbow connector part 90 in relation to the fixed second end 84, while the joint 96 allows rotation of the first elbow connector part 90 in relation to the fixed second elbow connector part 92. This double-swivel feature allows the roller air hose 76 to assume any desired position in relation to the inflatable roller 60 when the rollers 60 are rotated, while resisting twisting or kinking of the roller air hose 76.

Figure 7:
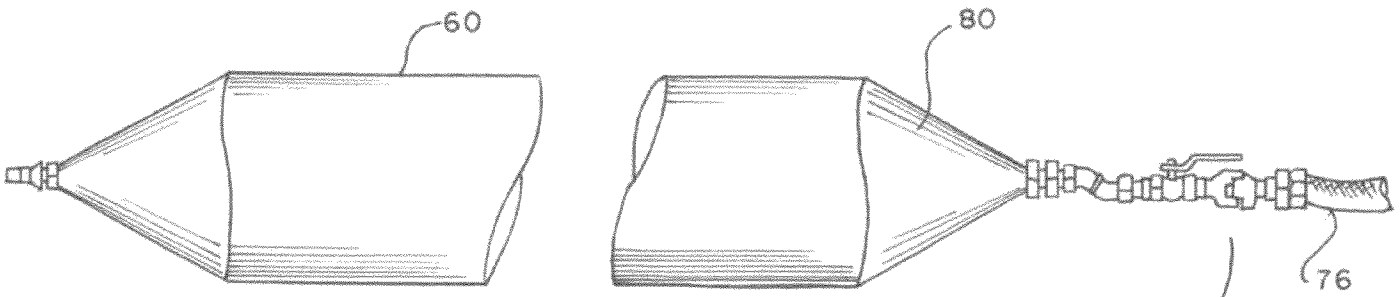
FIG. 7 is a detail view of a connector member connected to an air hose.
Figure 8:
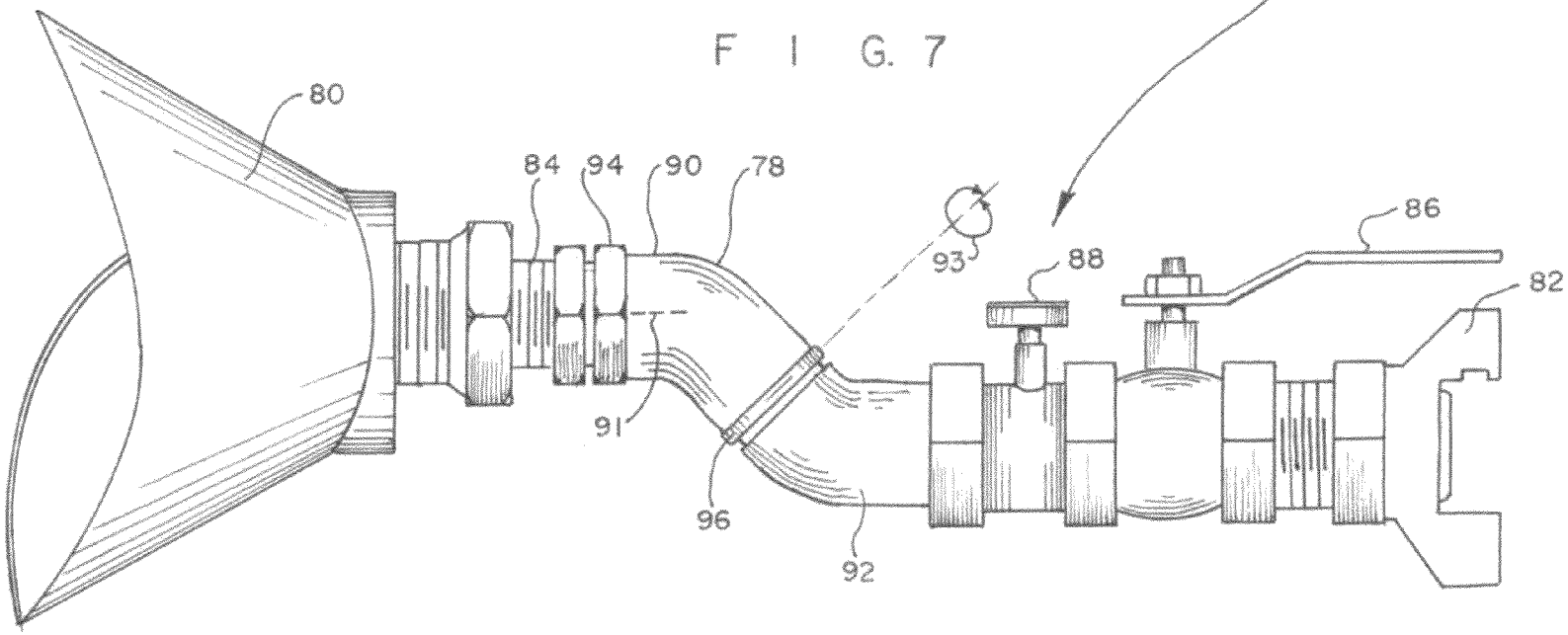
FIG. 8 is a detail view of a swivel connector member mounted between an inflatable air roller and a roller air hose.
Figure 9:
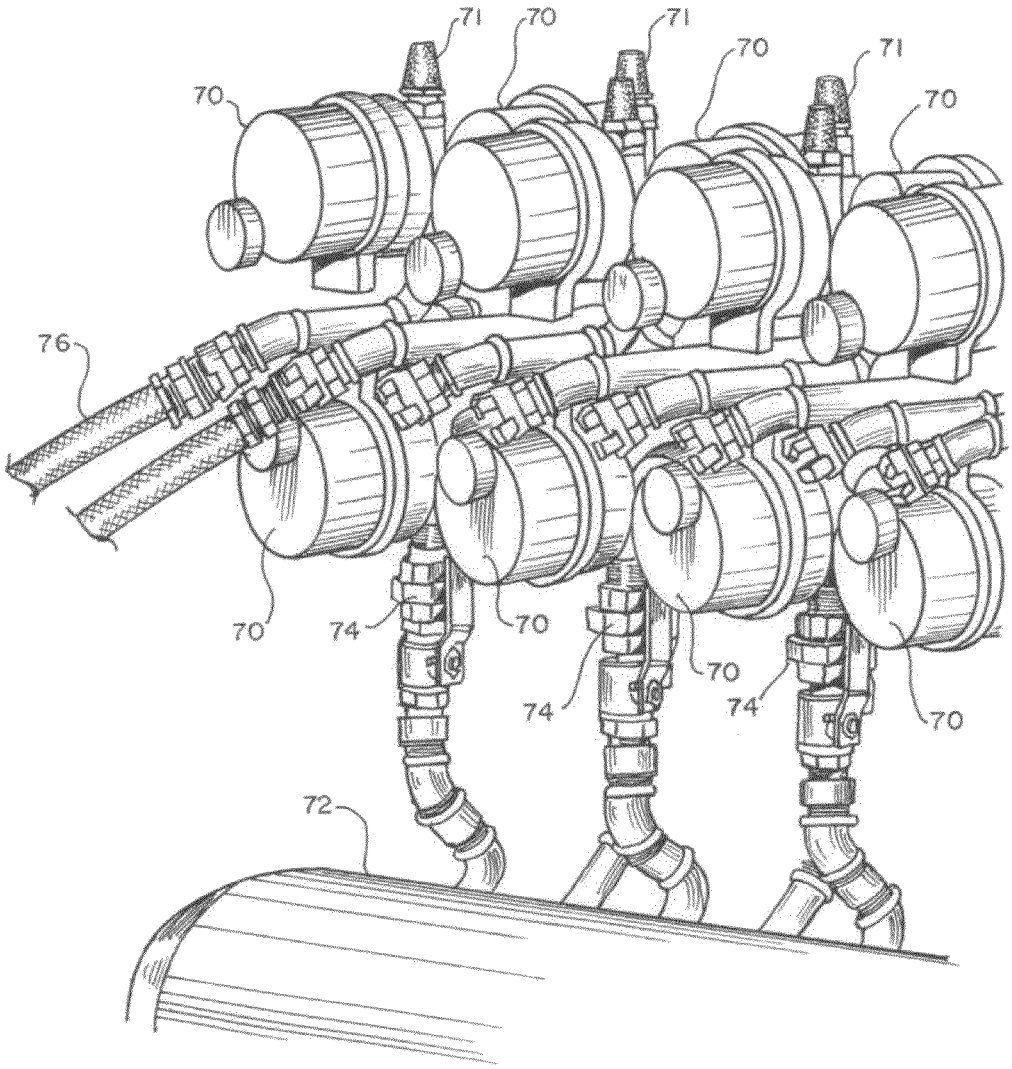
FIG. 9 is a detail view illustrating regulating and vent valves mounted in a control manifold unit.
Figure 10:
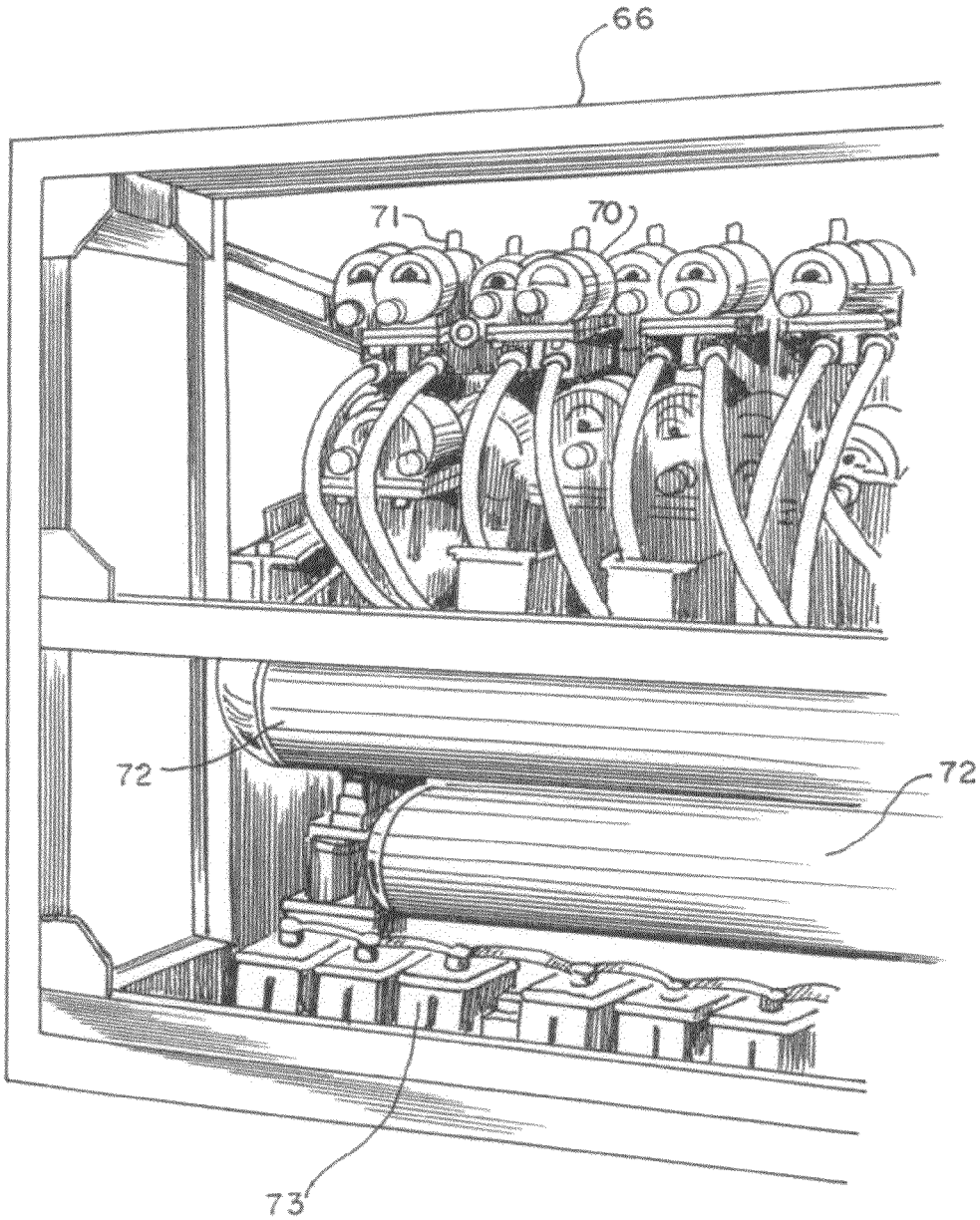
FIG. 10 is a detail view illustrating a control manifold unit with air tanks mounted below the regulating valves.

Each of the inflatable rollers 60 has a generally cylindrical configuration with hemispherical (FIGS. 2-6) or narrowed conical ends (FIGS. 7 and 8) suitable for connecting the roller air hoses 76 via the connector swivel member 78 thereto. In one aspect of the invention, the body of the inflatable roller 60 is formed from a flexible, scuff and puncture-resistant material. Since the inflatable rollers 60 are designed to move along rocky and sandy terrain, the scuff and puncture-resistant qualities ensure that an inflated roller does not lose its cylindrical configuration even when a heavy hull rests thereon. The rollers 60 easily adapt to the terrain by slightly deforming, if necessary, while still maintaining their substantially cylindrical configuration. In one of the preferred embodiments, each roller 60 is about 6 feet in diameter and 30 feet long, forming a bag capable of retaining about 7 PSI air pressure.

Figure 2:
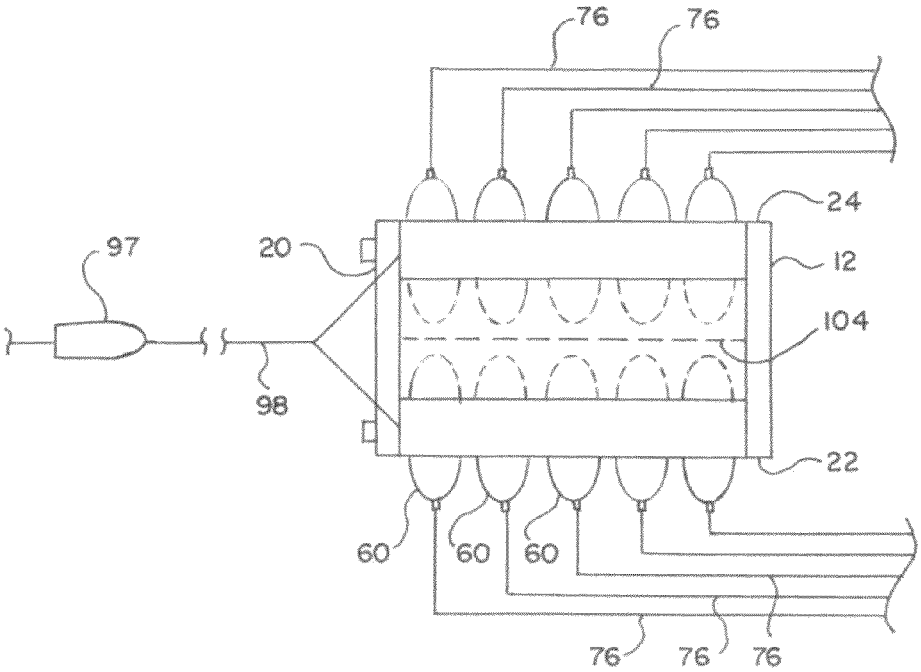
FIG. 2 is a schematic view illustrating connection of the inflatable rollers to individual manifolds.

Turning now to FIGS. 2-6, the method of refloating the vessel 12 will be discussed in more detail. FIG. 2 schematically illustrates the vessel 12 and a plurality of deflated rollers 60. The rollers 60 are positioned on the ground such that at least a part of each roller 60 extends outwardly from the sides of the hull. In the illustration of FIG. 2, five rollers 60 are used for port side and five rollers 60—for starboard side. Of course, depending on the size and mass of the hull more than five rollers 60 may be used per side, such for instance eight rollers 60 shown in FIG. 1. The buoyant inflatable rollers 60 are positioned with their longitudinal axes being substantially perpendicular to the hull sides. Each roller 60 is individually connected via its respective roller air hose 76 to the control manifold unit 66 or 68.

The hull 14 is tied to a pulling vehicle 97 by a pulling cable or chain 98, which is connected to the hull 14 at the bow, port and starboard sides. The pulling vehicle can be a tug boat if the vessel 12 is grounded close to the water edge or to a land moving vehicle first and then to a tug boat if the vessel 12 is located far inland. A winch 110 is mounted on the pulling vehicle, being it a land-based or water-based independently propelled vehicle. A load cell 112 can be secured to the pulling cable 98 to control the winch tension.

Figure 3:
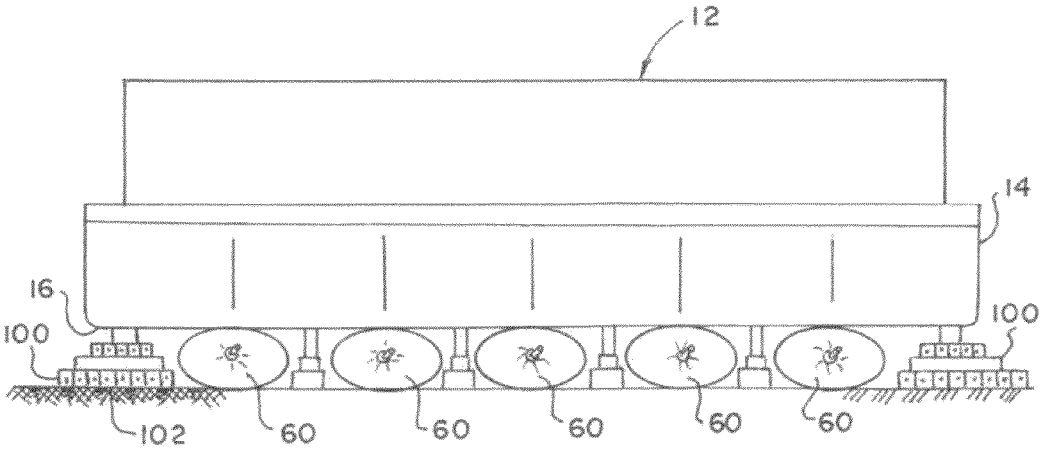
FIG. 3 is a side view illustrating position of the inflatable rollers under the hull bottom of a vessel.

FIG. 3 is a side view of the vessel 12 resting on spaced-apart temporary support blocks 100 which are placed under the hull bottom 16. The support blocks 100 can be different in height, depending on the terrain where the grounded vessel 12 is located. The rollers 60 are positioned on the ground 102 between the support blocks 100 and unrolled to extend toward the longitudinal centerline 104 of the hull 14. An operator ensures that the roller air hose 76 of each roller 60 is properly connected; the operator then initiates the roller inflating process.

Figure 4:
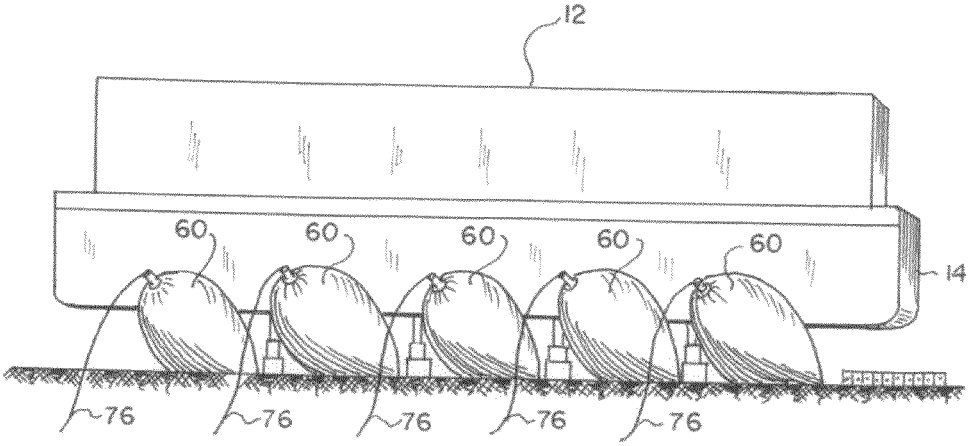
FIG. 4 showing the inflatable rollers supporting the hull bottom.

The operator is located in the control unit housing 32, with the control unit 30 receiving live feed from the cameras 46 placed around the vessel 12. The operator starts the flow of air into each individual roller 60 by a wireless signal sent from the antenna 36 to the control manifold units 66, 68. The air is allowed to gradually inflate the rollers 60 until such time as the bottom 16 of the hull 14 rests on the rollers 16 rather than the support blocks 100, as illustrated in FIG. 4.

Figure 5:
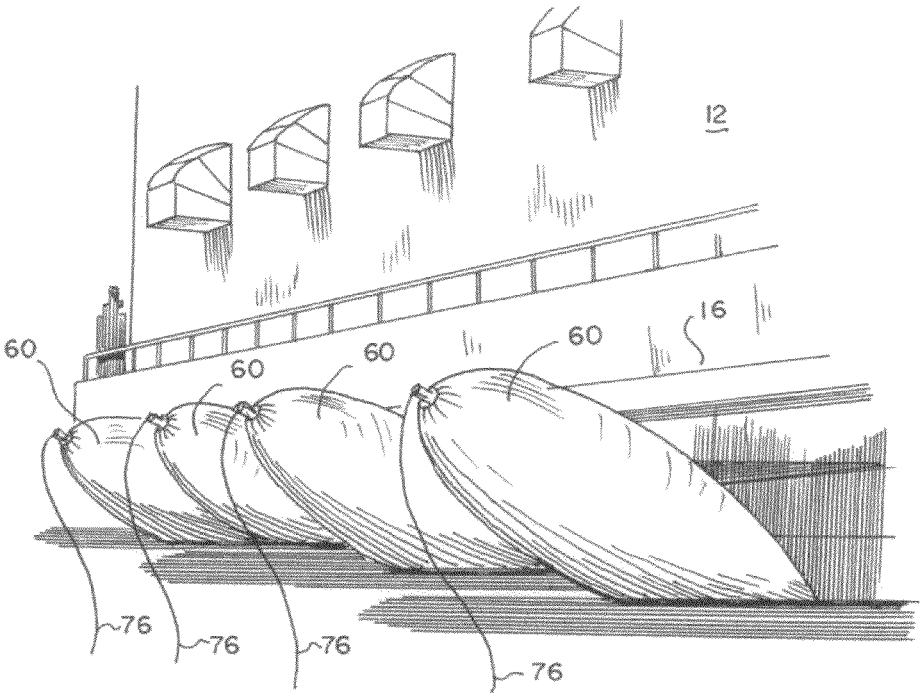
FIG. 5 is a detail view showing portions of the inflatable rollers located under the hull bottom.

Once the rollers 60 become sufficiently inflated, the support blocks 100 are removed and the hull 14 completely rests on the rollers 60, as shown in FIG. 5. If the operator detects that one side of the hull 14 is not even with the other side the operator remotely sends a signal to the control manifold unit, causing the air release valves 71 to open and release some air into the atmosphere. The slightly deflated roller 60 still maintains its substantially cylindrical configuration to serve as a roller. The winch is then operated to exert pulling force on the cable to propel the hull 14 seaward.

Figure 6:
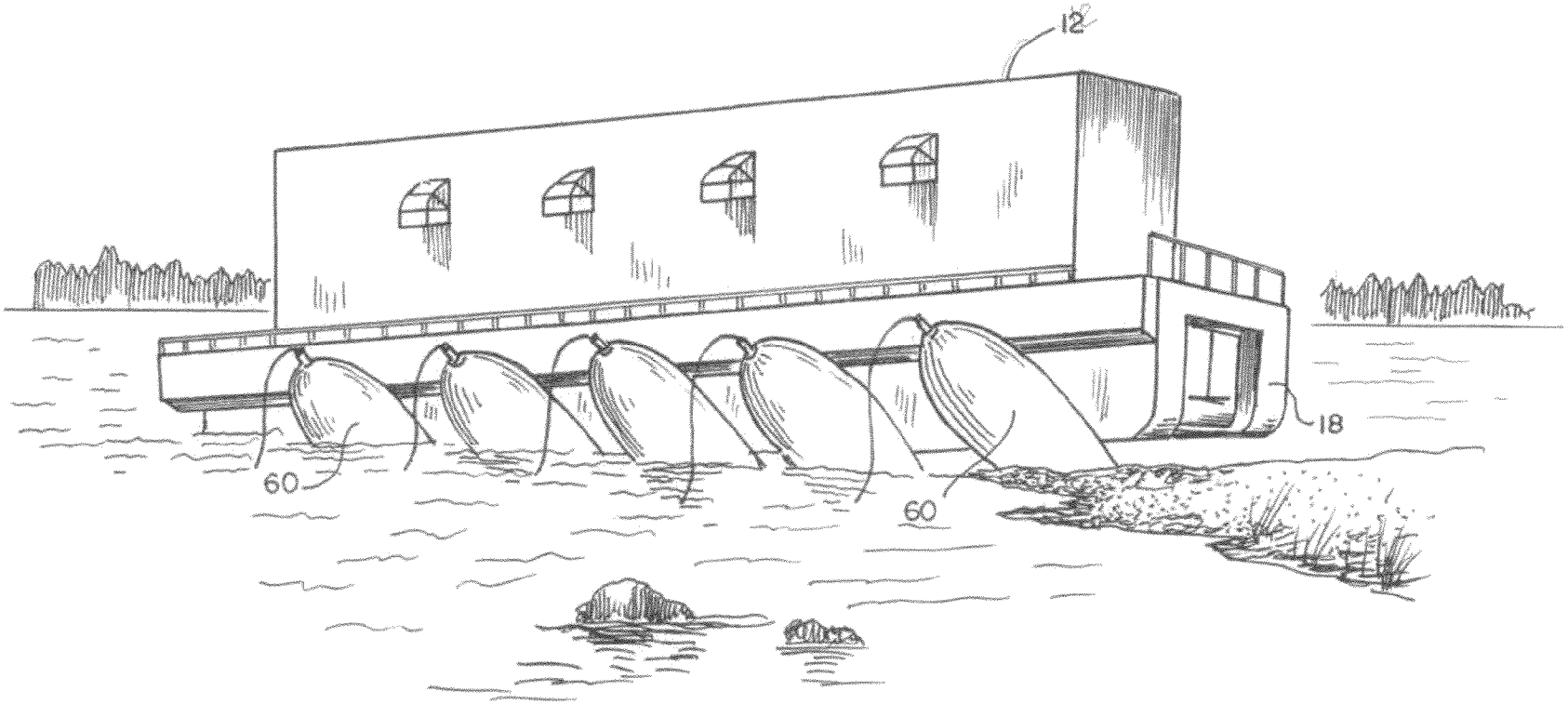
FIG. 6 illustrates a step of refloating the vessel using the inflatable rollers.

The vessel 12 is gradually pulled toward a waterway using the pulling vehicle 97. The bottom 16 of the hull 14 remains positioned on the rollers 60 as the vessel 12 is transported over the land. When the vessel 12 reaches the water edge, the forwardmost rollers 60 are rolled into the body of water 114, while the stern 18 still rests on the back rollers 60 remaining on the ground, as shown in FIG. 6. Continuous pulling of the vessel 12 into the water eventually causes the entire hull to be moved into the water. If the hull is still floatable, the vessel 12 can be tugged to the desired location for repairs or service. The buoyant floatable rollers 60 are retrieved and reused for other vessel refloating operation.

The refloating system of the present invention is considerably less expensive than traditional systems. The use of the system 10 can save tine in refloating a stranded vessel, making it more attractive than convention methods. Moreover, it can be successfully used regardless of the terrain where the vessel is grounded and even if the vessel is located at a substantial distance from a body of water.

Many changes and modifications can be made in the system and method of the present invention without departing from the spirit thereof. I, therefore, pray that my rights to the present invention be limited only by the scope of the appended claims.

I claim:

1. A system for refloating a grounded vessel having a hull, a hull bottom, a deck, and a bow portion, the system comprising:

a plurality of inflatable buoyant rollers positionable under the hull bottom while deflated;

a source of pressurized air for inflating the inflatable rollers;

a means for regulating delivery and release of pressurized air into the inflatable rollers, the means for regulating delivery and release of pressurized air comprising at least one air compressor operationally connected to each inflatable buoyant roller by individually operated air delivery conduit, a pressure regulating valve connected to each air delivery conduit, a pressure release valve connected to each air delivery conduit, and a computer-based control unit for controlling operation of each pressure regulating and each air release valve;

a means connected to the bow portion for exerting a pulling force on the hull while the vessel is being propelled seaward on inflated inflatable rollers; and a wireless communication means for transmitting control signals from the computer-based control unit to each pressure regulating valve and each air release valve.

2. A system for refloating a grounded vessel having a hull, a hull bottom, a deck, and a bow portion, the system comprising:

a plurality of inflatable buoyant rollers positionable under the hull bottom while deflated;

a source of pressurized air for inflating the inflatable rollers;

a means for regulating delivery and release of pressurized air into the inflatable rollers, the means for regulating delivery and release of pressurized air comprising at least one air compressor operationally connected to each inflatable buoyant roller by individually operated air delivery conduit, a pressure regulating valve connected to each air delivery conduit, a pressure release valve connected to each air delivery conduit, and a computer-based control unit for controlling operation of each pressure regulating and each air release valve;

a means connected to the bow portion for exerting a pulling force on the hull while the vessel is being propelled seaward on inflated inflatable rollers; and a plurality of video input devices positioned in proximity to, and on the deck of the grounded vessel, said video input devices communicating with the computer-based control unit.

3. A system for refloating a grounded vessel having a hull, a hull bottom, a deck, and a bow portion, the system comprising:

a plurality of inflatable buoyant rollers positionable under the hull bottom while deflated;

a source of pressurized air for inflating the inflatable rollers;

a means for regulating delivery and release of pressurized air into the inflatable rollers, the means for regulating delivery and release of pressurized air comprising at least one air compressor operationally connected to each inflatable buoyant roller by individually operated air delivery conduit, a pressure regulating valve connected to each air delivery conduit, a pressure release valve connected to each air delivery conduit, and a computer-based control unit for controlling operation of each pressure regulating and each air release valve;

a means connected to the bow portion for exerting a pulling force on the hull while the vessel is being propelled seaward on inflated inflatable rollers; and a control manifold unit mounted between the inflatable rollers and the at least one air compressor, the control manifold unit being provided with a plurality of roller air hoses, each roller air hose being engageable with a respective inflatable buoyant roller, and wherein a swivel connector member is mounted on each of said roller air hoses, the swivel connector member preventing twisting of the roller air hose.

4. The system of claim 3, said swivel connector member comprising a first end engageable with the roller air hose, and a second end engageable with an inflatable buoyant roller, a first elbow connector part mounted in a rotatable relationship to the second end of the swivel member, and a second elbow connector part rotatably engaged with the first elbow connector part.

5. The system of claim 4, wherein a pressure gauge is mounted between the second connector part and the roller air hose.

6. A system for refloating a grounded vessel having a hull, a hull bottom, a deck, and a bow portion, the system comprising:

a plurality of inflatable buoyant rollers positionable under the hull bottom while deflated;

a source of pressurized air for inflating the inflatable rollers;

a means for regulating delivery and release of pressurized air into the inflatable rollers, the means for regulating delivery and release of pressurized air comprising at least one air compressor operationally connected to each inflatable buoyant roller by individually operated air delivery conduit, a pressure regulating valve connected to each air delivery conduit, a pressure release valve connected to each air delivery conduit, and a computer-based control unit for controlling operation of each pressure regulating and each air release valve;

a means connected to the bow portion for exerting a pulling force on the hull while the vessel is being propelled seaward on inflated inflatable rollers; and a control manifold unit mounted between the inflatable rollers and the at least one air compressor, the control manifold unit being provided with a plurality of roller air hoses, each roller air hose being engageable with a respective inflatable buoyant roller, and wherein comprising a shut off valve is mounted on each of the roller air hoses.

7. A method of refloating a grounded floatable vessel having a hull, a hull bottom, a deck, and a bow portion, the method comprising the steps:

providing a plurality of buoyant inflatable rollers, each of said inflatable rollers having a substantially cylindrical configuration and a longitudinal axis, and wherein each of the inflatable rollers is positioned under the hull bottom with its longitudinal axis being oriented transversely to a longitudinal centerline of the vessel hull;

providing a source of pressurized air for inflating the inflatable rollers;

providing a means for regulating delivery and release of pressurized air into the inflatable rollers, the means for regulating delivery and release of pressurized air comprising at least one air compressor operationally connected to each inflatable roller by individually operated air delivery conduit, a pressure regulating valve connected to each air delivery conduit, a pressure release valve connected to each air delivery conduit, and a computer-based control unit for controlling operation of each pressure regulating valve and each air release valve;

providing a means connected to the bow portion for exerting a pulling force on the hull while the vessel is being propelled seaward on the inflatable rollers;

positioning deflated inflatable rollers in a spaced-apart relationship along hull sides and under the hull bottom;

energizing the means for regulating delivery and release of pressurized air into the inflatable rollers;

separately delivering pressurized air into each inflatable roller while inflating each inflatable roller to a sufficient degree to allow the hull bottom to rest on the inflatable rollers;

energizing the pulling force on the hull thereby causing the hull to move seaward while supported by the inflated inflatable rollers on the ground; and providing a wireless communication means for transmitting control signals from the computer-based control unit to each pressure regulating valve and each air release valve.

8. A method of refloating a grounded floatable vessel having a hull, a hull bottom, a deck, and a bow portion, the method comprising the steps:

providing a plurality of buoyant inflatable rollers, each of said inflatable rollers having a substantially cylindrical configuration and a longitudinal axis, and wherein each of the inflatable rollers is positioned under the hull bottom with its longitudinal axis being oriented transversely to a longitudinal centerline of the vessel hull;

providing a source of pressurized air for inflating the inflatable rollers;

providing a means for regulating delivery and release of pressurized air into the inflatable rollers, the means for regulating delivery and release of pressurized air comprising at least one air compressor operationally connected to each inflatable roller by individually operated air delivery conduit, a pressure regulating valve connected to each air delivery conduit, a pressure release valve connected to each air delivery conduit, and a computer-based control unit for controlling operation of each pressure regulating valve and each air release valve;

providing a means connected to the bow portion for exerting a pulling force on the hull while the vessel is being propelled seaward on the inflatable rollers;

positioning deflated inflatable rollers in a spaced-apart relationship along hull sides and under the hull bottom;

energizing the means for regulating delivery and release of pressurized air into the inflatable rollers;

separately delivering pressurized air into each inflatable roller while inflating each inflatable roller to a sufficient degree to allow the hull bottom to rest on the inflatable rollers;

energizing the pulling force on the hull thereby causing the hull to move seaward while supported by the inflated inflatable rollers on the ground; and providing a plurality of video input devices positioned in proximity to, and on the deck of the grounded vessel, said video input devices communicating with the computer-based control unit.

9. A method of refloating a grounded floatable vessel having a hull, a hull bottom, a deck, and a bow portion, the method comprising the steps:

providing a plurality of buoyant inflatable rollers, each of said inflatable rollers having a substantially cylindrical configuration and a longitudinal axis, and wherein each of the inflatable rollers is positioned under the hull bottom with its longitudinal axis being oriented transversely to a longitudinal centerline of the vessel hull;

providing a source of pressurized air for inflating the inflatable rollers;

providing a means for regulating delivery and release of pressurized air into the inflatable rollers, the means for regulating delivery and release of pressurized air comprising at least one air compressor operationally connected to each inflatable roller by individually operated air delivery conduit, a pressure regulating valve connected to each air delivery conduit, a pressure release valve connected to each air delivery conduit, and a computer-based control unit for controlling operation of each pressure regulating valve and each air release valve;

providing a control manifold unit mounted between the inflatable rollers and the at least one air compressor, the control manifold unit being provided with a plurality of roller air hoses, each roller air hose being engageable with a respective inflatable roller, wherein a swivel connector member is mounted on each of said roller air hoses, the swivel connector member preventing twisting of the roller air hose;

providing a means connected to the bow portion for exerting a pulling force on the hull while the vessel is being propelled seaward on the inflatable rollers;

positioning deflated inflatable rollers in a spaced-apart relationship along hull sides and under the hull bottom;

energizing the means for regulating delivery and release of pressurized air into the inflatable rollers;

separately delivering pressurized air into each inflatable roller while inflating each inflatable roller to a sufficient degree to allow the hull bottom to rest on the inflatable rollers;

energizing the pulling force on the hull thereby causing the hull to move seaward while supported by the inflated inflatable rollers on the ground.

10. The method of claim 9, wherein said swivel connector member comprises a first end engageable with the roller air hose and a second end engageable with an inflatable roller, a first elbow connector part mounted in a rotatable relationship to the second end of the swivel connector member, and a second elbow connector part rotatably engaged with the first elbow connector part.

11. The method of claim 10, providing a step of mounting a pressure gauge between the second connector part and the roller air hose.

12. A method of refloating a grounded floatable vessel having a hull, a hull bottom, a deck, and a bow portion, the method comprising the steps:

providing a plurality of buoyant inflatable rollers, each of said inflatable rollers having a substantially cylindrical configuration and a longitudinal axis, and wherein each of the inflatable rollers is positioned under the hull bottom with its longitudinal axis being oriented transversely to a longitudinal centerline of the vessel hull;

providing a source of pressurized air for inflating the inflatable rollers;

providing a means for regulating delivery and release of pressurized air into the inflatable rollers, the means for regulating delivery and release of pressurized air comprising at least one air compressor operationally connected to each inflatable roller by individually operated air delivery conduit, a pressure regulating valve connected to each air delivery conduit, a pressure release valve connected to each air delivery conduit, and a computer-based control unit for controlling operation of each pressure regulating valve and each air release valve;

providing a control manifold unit mounted between the inflatable rollers and the at least one air compressor, the control manifold unit being provided with a plurality of roller air hoses, each roller air hose being engageable with a respective inflatable roller, and mounting a shut off valve on each of the roller air hoses;

positioning deflated inflatable rollers in a spaced-apart relationship along hull sides and under the hull bottom;

energizing the means for regulating delivery and release of pressurized air into the inflatable rollers;

separately delivering pressurized air into each inflatable roller while inflating each inflatable roller to a sufficient degree to allow the hull bottom to rest on the inflatable rollers;

energizing the pulling force on the hull thereby causing the hull to move seaward while supported by the inflated inflatable rollers on the ground.

* * * * *